US010900302B2

(12) United States Patent
Kysely

(10) Patent No.: US 10,900,302 B2
(45) Date of Patent: Jan. 26, 2021

(54) DIRECTIONAL DRILLING SYSTEMS, APPARATUSES, AND METHODS

(71) Applicant: Country Landscapes & Tree Service, LLC, Palmyra, WI (US)

(72) Inventor: Joseph H. Kysely, Palmyra, WI (US)

(73) Assignee: Country Landscapes & Tree Service, LLC, Palmyra, WI (US)

( * ) Notice: Subject to any disclaimer, the term of this patent is extended or adjusted under 35 U.S.C. 154(b) by 0 days.

(21) Appl. No.: 16/516,733

(22) Filed: Jul. 19, 2019

(65) Prior Publication Data

US 2020/0032598 A1 Jan. 30, 2020

Related U.S. Application Data

(60) Provisional application No. 62/711,047, filed on Jul. 27, 2018.

(51) Int. Cl.

| | |
|---|---|
| ***E21B 21/00*** | (2006.01) |
| ***E21B 7/28*** | (2006.01) |
| ***E21B 7/04*** | (2006.01) |
| *E21B 7/00* | (2006.01) |
| *E21B 7/20* | (2006.01) |
| *E21B 10/26* | (2006.01) |

(52) U.S. Cl.

CPC ..... *E21B 21/00* (2013.01); *E21B 7/046* (2013.01); *E21B 7/28* (2013.01); *E21B 7/005* (2013.01); *E21B 7/20* (2013.01); *E21B 7/201* (2013.01); *E21B 10/26* (2013.01)

(58) Field of Classification Search

CPC . E21B 21/00; E21B 7/046; E21B 7/28; E21B 7/005; E21B 7/20; E21B 7/201; E21B 10/26

See application file for complete search history.

(56) References Cited

U.S. PATENT DOCUMENTS

| | | | |
|---|---|---|---|
| 3,298,322 | A | 1/1967 | Sherrod |
| 3,331,332 | A | 7/1967 | Wennberg |
| 3,663,129 | A | 5/1972 | Antosh |

(Continued)

OTHER PUBLICATIONS

Petrie, R. and Canon, F. "Downhole Pressure: Friend or Frac-out?" Baroid Industrial Drilling Products Publications/Tech Papers, retrieved from https://www.baroididp.com/idp/resources/technical-assistance/publications/tech-papers/downhole-pressure-friend-or-frac-out/downhole-pressure.html on Jun. 19, 2019.

(Continued)

*Primary Examiner* — Nicole Coy

(74) *Attorney, Agent, or Firm* — Andrus Intellectual Property Law, LLP

(57) ABSTRACT

A boring apparatus for coupling to a drill rod and drilling a borehole includes a boring tool head configured to couple to the drill rod and receive drilling fluid. The boring tool head has an exterior surface with a hole and defines an internal cavity. The hole is configured to receive ground spoils such that the ground spoils are conveyed into the internal cavity, and the drilling fluid dispenses into the cavity such that the drilling fluid mixes with the ground spoils to form a drilling slurry. A housing is coupled to the boring tool head and has a chamber in fluid communication with the cavity. A pump in the chamber is configured to pump the drilling slurry out of the cavity and the chamber.

13 Claims, 7 Drawing Sheets

(56) References Cited

U.S. PATENT DOCUMENTS

| | | | | |
|---|---|---|---|---|
| 3,726,614 | A | 4/1973 | Schellenberg | |
| 3,832,097 | A | 8/1974 | Schelch | |
| 3,909,160 | A | 9/1975 | Sherrod | |
| 3,938,598 | A | 2/1976 | Watts | |
| 3,989,420 | A | 11/1976 | Taylor | |
| 4,242,057 | A | 12/1980 | Bender | |
| 4,358,257 | A | 11/1982 | Seiler et al. | |
| 4,369,002 | A | 1/1983 | Kostylev et al. | |
| 4,373,875 | A | 2/1983 | Schwing | |
| 4,486,124 | A * | 12/1984 | Yamamuro | E21B 7/005 175/62 |
| 4,769,156 | A | 9/1988 | Watts | |
| 4,797,031 | A | 1/1989 | Hagimoto et al. | |
| 4,979,884 | A | 12/1990 | Letarte et al. | |
| 5,096,002 | A * | 3/1992 | Cherrington | E21B 7/20 175/53 |
| 5,360,321 | A | 11/1994 | Benckert et al. | |
| 5,616,009 | A | 4/1997 | Birdwell | |
| 5,879,057 | A | 3/1999 | Schwoebel et al. | |
| 6,424,246 | B1 | 7/2002 | Kysely et al. | |
| 6,443,718 | B1 | 9/2002 | Vincent | |
| 6,450,779 | B1 | 9/2002 | Schwing | |
| 6,460,936 | B1 | 10/2002 | Abramov et al. | |
| 6,484,819 | B1 | 11/2002 | Harrison | |
| 6,688,702 | B1 | 2/2004 | Abramov et al. | |
| 6,821,097 | B2 | 11/2004 | Reinert | |
| 6,857,861 | B2 | 2/2005 | Condon et al. | |
| 6,868,921 | B2 | 3/2005 | Burrows et al. | |
| 6,953,306 | B2 | 10/2005 | McGillis | |
| 6,963,025 | B1 | 11/2005 | Kysely | |
| 6,986,303 | B2 | 1/2006 | Remus | |
| 7,137,616 | B2 | 11/2006 | Kysely | |
| 7,407,022 | B2 | 8/2008 | Mundell et al. | |
| 7,510,025 | B2 | 3/2009 | Davies | |
| 7,771,174 | B2 | 8/2010 | Lenhart | |
| 7,905,291 | B2 | 3/2011 | Kotsonis et al. | |
| 7,942,217 | B2 | 5/2011 | Salins et al. | |
| 8,303,272 | B2 | 11/2012 | Pugh et al. | |
| 8,439,657 | B2 | 5/2013 | Drago | |
| 8,684,470 | B2 | 4/2014 | Harrison et al. | |
| 8,770,270 | B2 | 7/2014 | Wilson | |
| 8,827,657 | B1 | 9/2014 | Priddy | |
| 9,046,086 | B2 | 6/2015 | Schwing et al. | |
| 9,765,768 | B2 | 9/2017 | Priddy | |
| 10,047,562 | B1 | 8/2018 | Cherrington | |
| 10,113,369 | B1 | 10/2018 | Barbera | |
| 10,180,031 | B2 * | 1/2019 | Engle | E21B 7/005 |
| 10,526,846 | B2 * | 1/2020 | Barbera | E21B 7/20 |
| 2007/0274850 | A1 | 11/2007 | Muller et al. | |
| 2010/0116508 | A1 | 5/2010 | Oglesby | |
| 2011/0061873 | A1 | 3/2011 | Patterson et al. | |
| 2011/0100641 | A1 | 5/2011 | Briquet et al. | |
| 2012/0175127 | A1 | 7/2012 | Yale et al. | |
| 2012/0219363 | A1 | 8/2012 | Dimitroff | |
| 2016/0160566 | A1 * | 6/2016 | Engle | E21B 7/28 175/62 |

OTHER PUBLICATIONS

Kennedy, M. et al. "Limiting Drilling Slurry Pressures to Control Hydraulic Fracturing During HDD Through Purely Cohesive Soil", 57th Canadian Geotechnical Conference, 2004, Session 4E, pp. 37-44, Quebec, Canada, retrieved rrom http://citeseerx.ist.psu.edu/viewdoc/download?doi=10.1.1.508.9736&rep=rep1&type=pdf on Jun. 19, 2019.

"Reducing Pavement Cuts by Integrating Technology", U.S. Department of Transportation Federal Highway Adminstration, Utility Program Publications, updated Apr. 19, 2018, retrieved from https://www.fhwa.dot.gov/utilities/utilitycuts/man04.cfm on Jun. 19, 2019.

"Helical Hydraulic Rotary Actuators: Series L and T", Helac Rotary Actuator Catalog, HY34-1000, Parker Hannifin Corporation, Enumclaw, Washington, U.S.A., retrieved from https://www.helac.com/uploads/file/actuators/product-prochures/HY34-1000_Helac_Rotary_Actuator_Catalog_09142017.pdf on Jun. 19, 2019.

"Horizontal Directional Drilling; Theory, Practical Information and Tips", Vermeer Middle East FZCO website, 2019, retrieved from https://vermeer-middleeast.com/pipeline-installation/horizontal-directional-drilling on Jun. 19, 2019.

"The Directional Boring Advantage", Directional Boring Central website, retrieved from http://www.directionalboringcentral.com/library/dba/dbapamphlet.htm on Jun. 19, 2019.

Thomson, James. "Pipejacking and Microtunnelling", pp. 61-65, Springer Science+Business Media Dordrecht, 1993. Retrieved from https://books.google.com/books?id=47rzBwAAQBAJ&pg=PA262&dq=an+introduction+to+pipe+jacking+and+microtunneling+james+thomson&hl=en&sa=X&ved=0ahUKEwjAj129wPjiAhVL-qwKHeJGBdMQ6AEIKdAA#v=onepage&q=an%20introduction%20to%20pipe%20jacking%20and%20microtunneling%20james%20thomson&f=false on Jun. 19, 2019.

Nicholas, Paul. "Large Diameter Trenchless Pipeline Construction", 2016 PowerPoint Presentation, Pacific Northwest Chapter of NASTT website, retrieved from https://www.pnwnastt.org/docs/Large%20Diameter%20Trenchless%20Pipeline%20Construction-PNW%202017.pdf on Jun. 19, 2019.

Dugan, George. "How to Create Borehole Stability Using Drilling Fluid or Slurry", National Driller website, Jan. 1, 2015, retrieved from https://www.nationaldriller.com/articles/89844-how-to-create-borehole-stability-using-drilling-fluid-or-slurry on Jun. 19, 2019.

"Slewing Ring Bearings XR Series", Kaydon Bearings website, 2019, retrieved from https://www.kaydonbearings.com/XR_turntable_bearings.htm on Jun. 19, 2019.

"HDD Thread Reference", Radius HDD Direct, LLC website, 2019, retrieved from https://www.radiushdd.com/hdd-thread-reference on Jun. 19, 2019.

"First Choice for Innovative Positive Displacement Slurry Pumps", Weir Minerals Netherlands b.v. Brochure, 2015, Weir Minerals Netherlands b.v. website, retrieved from https://www.global.weir/assets/files/product%20brochures/brochure%20EN-GEHO%20PD%20pump%20range.pdf on Jun. 19, 2019.

"SP Pumpkit Reference Guide", Schwing America Inc. website, 2018, retrieved from https://35dyem3oph321z6xwa2rhxs7-wpengine.netdna-ssl.com/wp-content/uploads/2018/07/2018-SP-Pumpkit-Wear-Parts-Guide.pdf on Jun. 19, 2019.

"Technology in Mining: Safe and Economic Transportation of Material", Putzmeister Industrial Technology (Russia) website, 2019, retrieved from https://www.putzmeister.ru/images/smartfieldsdata/899/files/technology-mining-eng-pdf.pdf on Jun. 19, 2019.

"Drill Master: Drilling Fluid Rules of Thumb", Trenchless Technology Magazine (digital), Jun. 1, 2004, retrieved from https://trenchlesstechnology.com/drill-master-drilling-fluid-rules-of-thumb/ on Jun. 19, 2019.

* cited by examiner

DIRECTIONAL DRILLING SYSTEMS, APPARATUSES, AND METHODS

CROSS-REFERENCE TO RELATED APPLICATION

The present disclosure is based on and claims priority to U.S. Provisional Patent Application No. 62/711,047 filed Jul. 27, 2018, the disclosure of which is incorporated herein by reference.

FIELD

The present disclosure relates to underground drilling and boring and more specifically relates to directional drilling systems, apparatuses, and methods.

BACKGROUND

Underground infrastructure, including thousands of miles of underground utility piping systems, have or are reaching the end of their useful life due to corrosion of the steel materials used, leaks, and/or electrical faults. Accordingly, these systems must be replaced. Directional drilling, such as horizontal directional drilling (HDD), has been a preferred method of installing and/or replacing aging underground utility piping systems due to low cost and low impact on surroundings. In many situations, directional drilling is often preferred over other methods such as open trenching, micro-tunneling, or augar boring. Generally, directional drilling is a trenchless method of installing or replacing underground utility infrastructure, such as water and sewer mains, natural gas lines, telecommunication cables, and electric power cables and conduits. Examples of directional drilling systems, methods, and apparatuses are described in U.S. Pat. Nos. 6,868,921 and 6,484,819, which are incorporated herein by reference in entirety.

In one example of directional drilling, a directional drilling system is placed on the ground and a drill rig drills a hole with a boring head at an oblique angle relative to the ground. The boring head is attached to a drill rod, and drilling fluid is conveyed through the drill rod to the boring head where the drilling fluid is used to cool and lubricate the boring head and to remove drill cuttings as the drilling fluid flows over the boring head and back along the drill rod to the initial hole where cuttings and spoil are to be removed. The drill rig controls the direction of the boring head to thereby create a continuous pilot bore that includes horizontal sections and/or vertical sections. At the end the pilot bore, an exit hole is created in the ground and the boring head and a portion of the drill rod extend out of the exit hole. Once the pilot bore is established, a reaming tool is attached to the drill rod, and the reaming tool is pulled back through the pilot bore to thereby ream or enlarge the pilot bore and create an enlarged borehole. That is, the reaming tool increases the diameter of the pilot bore and forms an enlarged borehole that accommodates the new product pipe. At the same time, the new product pipe to be installed is connected to the reaming tool such that the new product pipe is installed as the reaming tool is pulled back through the borehole. In another example of directional drilling, a large diameter steel casing is utilized as part of the pilot drill rod. Once the casing is installed, it is then utilized as the new product pipe.

There are many benefits and cost-saving opportunities realized when utilizing directional drilling to install underground utilities, especially in urban environments. However, there are several concerns or risks that are often considered when utilizing directional drilling methods to install underground utilities. Hitting or damaging existing utilities or other underground infrastructure is an example concern that is common and often addressed or alleviated by exposing all utility or infrastructure commonly referred to as potholing. Another example concern, commonly termed in the industry as "hydraulic fracturing" or "inadvertent returns", is when drilling fluid/spoil flows into locations outside the borehole, such as into cracks in the ground, into environmentally sensitive waterways, or into home basements. The drilling fluid and associated remove soils (e.g., a drilling slurry) can cause significant damage and can be a common problem when the borehole is made at shallow elevations, e.g. there is not enough ground cover to keep the spoils contained. Another example concern is soil displacement near the new product line or pipe. Soil displacement may be caused by insufficient ground cover above the new product line or pipe. Soils displaced are typically not compressible and if the soil displaced by the new product pipe is not removed, the pressure exerted by the displaced soil can damage other underground utilities or infrastructure and cause unwanted bulging of streets, sidewalks, or other landscaping. Furthermore, loss of downhole pressure of the drilling fluid in the borehole can cause portions of the borehole to collapse when not supported by the new product pipe being installed. Factors that affect the downhole pressure the drilling fluid include hole diameters and volumes, hydrolock or losing flow, and/or drilling slurry weight and circulating pressures.

Advances in directional drilling systems and underground utility piping systems advantageously drill large diameter boreholes to allow large diameter piping systems to be installed via the HDD method. Unfortunately, these advancements have increased the concerns noted above as the large diameter boreholes require strict adherence to basic drilling principles and are often unforgiving if basic drilling principles are not followed. Furthermore, large diameter boreholes also increase the volume of drilling fluid necessary for drilling operation and thereby increases the cost of drilling. Loss of drilling fluid, through hydraulic fracturing can be costly to contractors.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a boring apparatus for coupling to a drill rod and drilling a borehole includes a boring tool head configured to couple to the drill rod and receive drilling fluid. The boring tool head has an exterior surface with a hole and defines a cavity. The hole is configured to permit ground spoils to pass into the cavity, and the drilling fluid dispenses into the cavity and mixes with the ground spoils to form a drilling slurry. A housing is coupled to the boring tool head and has a chamber in fluid communication with the cavity, and a pump in the chamber is configured to pump the drilling slurry out of the cavity and the chamber.

In certain examples, a method of drilling a borehole with a diameter greater than a diameter of an existing pilot hole includes pulling a boring apparatus having a pump through the pilot hole to thereby drill the borehole, receiving drilling fluid into the boring apparatus, receiving ground spoils into the boring apparatus that are generated as the boring apparatus is pulled through the pilot hole such that the drilling fluid and the ground spoils mix to form a drilling slurry, and pumping the drilling slurry out of the boring apparatus and the borehole.

In certain examples, a method of drilling a borehole includes pushing a boring apparatus having a pump through ground to thereby drill the borehole, receiving drilling fluid into the boring apparatus, receiving ground spoils into the boring apparatus that are generated as the boring apparatus is pushed through ground such that the drilling fluid and the ground spoils mix to form a drilling slurry, and pumping the drilling slurry out of the boring apparatus and the borehole.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DISCLOSURE

The present inventor has endeavored to develop improved directional drilling systems that minimize common concerns and/or disadvantages of conventional direction drilling systems, some of which are note above in the Background section. Accordingly, through research and development, the present inventor has developed the apparatuses, systems, and methods of the present disclosure. The apparatuses, systems, and methods of the present disclosure include many improvements and/or benefits relative to conventional horizontal directional drilling systems. For example, the apparatuses, systems, and methods of the present disclosure can pump the drilling fluid and/or drilling slurry from the borehole thereby reducing downhole fluid pressures, can be used for shallow horizontal directional drilling (HHD), permit installation of large diameter pipes in a single pass thereby eliminating multiple reaming operations, improve efficiency of drilling teams, and/or reducing pullback forces on the new product pipe and reducing drill fluid usage. Furthermore, the apparatuses, systems, and methods of the present disclosure can reduce the risk associated with the borehole collapsing, reduce settling of soils around the new product pipe (e.g., prevent dips in pavement), prevent damage to other underground utilities or facilities, and/or prevent damage to street sidewalks and landscaping (e.g., reducing bulging of ground surfaces). Furthermore, the apparatuses, systems, and methods of the present disclosure may reduce drilling costs, permit increased length of pipe to be installed without steel casing, minimize the amount of ground spoils removed during drilling, reduce cost of installation, reduce pullback forces that are experienced by the pipe during pullback operations, create a flowable drilling slurry, reduce drilling fluid costs by increased recycling and control of the drilling fluid, reduce environmental damage and risk, reduce risk of damaging other underground utilities or facilities, reduce risk of getting pipe or drilling components stuck in the borehole, and/or maintain the diameter of the borehole as product pipe is installed.

Figure 1:
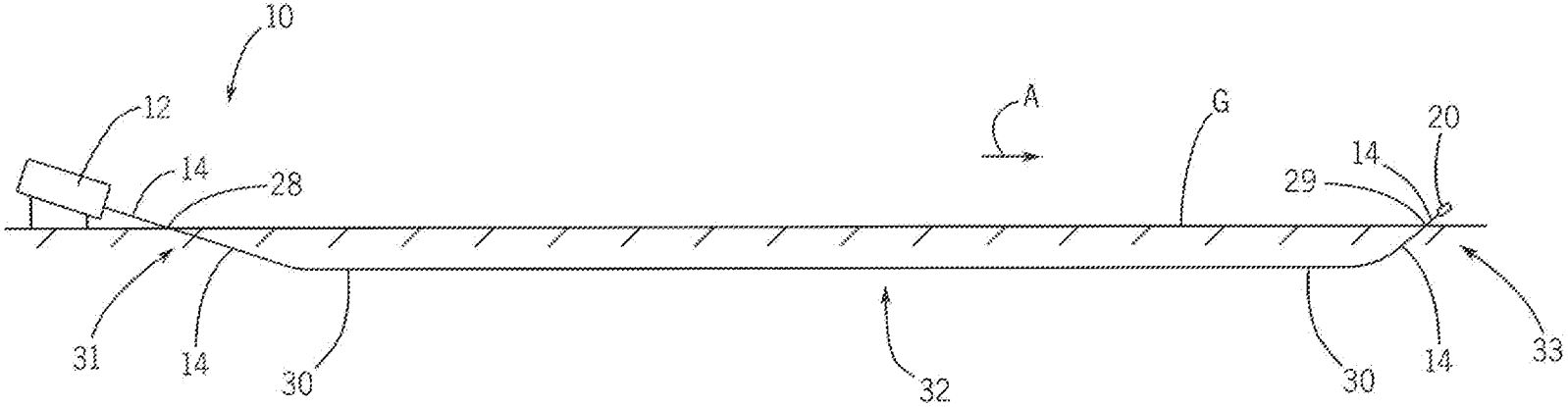
FIG. 1 is a schematic view of an example directional drilling system according to the present disclosure showing a pilot hole created by a pilot bore drill head.
Figure 2:
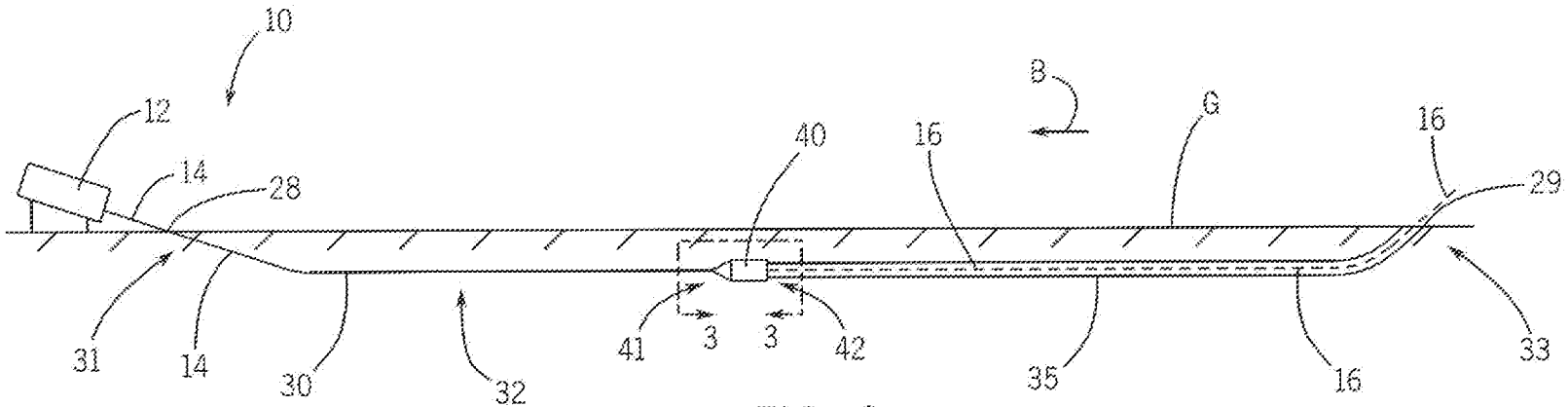
FIG. 2 is a schematic view like FIG. 1 with an example boring apparatus of the present disclosure depicted in the pilot hole and forming a borehole. Product pipe is depicted connected to the boring tool and installed in the borehole.

FIGS. 1-2 depict an example directional drilling system 10 of the present disclosure. In particular, FIG. 1 depicts a pilot bore 30 drilled through the ground G by the system 10. The system 10 includes a drilling rig 12 having a drill rod 14 and a pilot bore drill head 20 attached to the drill rod 14. In operation, the drilling rig 12 applies a force (e.g., pushes) on and/or rotates the drill rod 14 to thereby the push and/or rotate the pilot bore drill head 20 into the ground G to thereby drill the pilot bore 30. As such, the pilot bore drill head 20 and the drill rod 14 are moved through the ground G in a first direction (see arrow A) away from the drilling rig 12. The length and path of the pilot bore 30 can vary, and the drilling rig 12 controls the pilot bore drill head 20 and the drill rod 14 such that the pilot bore 30 is drilled along a desired path. In the example depicted in FIG. 1, the pilot bore 30 has an entrance hole 28, a vertically downwardly directed section 31, a generally horizontal section 32, a vertically upwardly directed section 33, and an exit hole 29. The pilot bore drill head 20 is pushed out of the ground G at the exit hole 29 such that the pilot bore drill head 20 and/or a portion of the drill rod 14 is above the ground G, as depicted in FIG. 1. The diameter of the pilot bore 30 (see D1 on FIG. 4) corresponds to the diameter of the drill rod 14 and the pilot bore drill head 20. The diameter of the pilot bore 30 can vary (e.g., two-inch diameter, three-inch diameter). Note that in FIGS. 1-2 the line depicting the drill rod 14 is depicted superimposed on the pilot bore 30. In certain examples, the drilling rig 12 can include a power take off (PTO) shaft down the center of the drill rod 14 to drive a pump 100 of a boring apparatus or tool 40 (described further herein below). In another example, rotation of the drill rod 14 relative to the housing 70 of the boring tool 40 may also be utilized to drive the pump 100. In certain examples, an electrically driven hydraulic pump or hydraulic or pneumatic hoses strung through the product pipe 16 can also drive the pump 100.

Referring now to FIG. 2, the pilot bore drill head 20 (FIG. 1) is disconnected from the drill rod 14 and a boring apparatus or tool 40 of the system 10 is connected to the drill rod 14. The drilling rig 12 then pulls the drill rod 14, and thereby the boring tool 40, back through the pilot bore 30 in a second direction (see arrow B) such that the boring tool 40 drills or enlarges the pilot bore 30 into a borehole 35 with a diameter greater than the diameter of the pilot bore 30. Note that FIG. 2 depicts the drill rod 14 and the boring tool 40 partially pulled back through the pilot bore 30. The diameter of the borehole 35 (see D2 on FIG. 4) is greater than the diameter of the pilot bore 30 (see D1 on FIG. 4), and the diameter of the borehole 35 corresponds to the diameter of the boring tool 40 (described hereinbelow). A person of ordinary skill in the art will recognize that the diameter of the borehole 35 can vary (e.g., six-inch diameter, twelve-inches diameter, thirty-six-inches diameter). In one non-limiting example, the diameter of the pilot bore 30 is three-inches and the diameter of the borehole 35 is twelve inches. The operation and components of the boring tool 40 are described in greater detail hereinbelow.

As the boring tool 40 is pulled through the pilot bore 30 in the second direction B, the boring tool 40 drills the ground G and pumps ground spoils S and drilling fluid F (collectively referred to as drilling slurry SF) out of the borehole 35 (described in greater detail hereinbelow). Note that spoils S are the smaller pieces of the ground G (e.g., dust, small rocks, clusters of dirt, etc.) that are generated as the borehole 35 is drilled through the ground G. The boring tool 40 also pulls product pipe 16 (depicted as a dashed line in FIG. 2) into the borehole 35 as the boring tool 40 drills the borehole 35. In particular, the boring tool 40 has an arbor 90 that connects to the product pipe 16 such that as the boring tool 40 is pulled along the pilot bore 30 by the drill rod 14 and the drilling rig 12 the product pipe 16 is immediately pulled and installed into the borehole 35. In one example, the arbor 90 includes mechanical fasteners (e.g., nuts and bolts) and hardware member (e.g., steel bars, clamp arms). The size (e.g., the diameter) of the new product pipe 16 corresponds to the diameter of the borehole 35 and/or the boring tool 40. Immediately installing the product pipe 16 into the borehole 35 minimizes the overall amount of time needed to install the product pipe 16 into the ground G and minimizes the risk that the borehole 35 will collapse before installation of the product pipe 16. The drill rod 14 and the boring tool 40 are pulled along and through the entire length of the pilot bore 30 until the drill rod 14, the boring tool 40, and/or the product pipe 16 are pulled out through of the entrance hole 28. Accordingly, the new product pipe 16 extends in the entire length of the borehole 35 and no additional passes of components of the system 10 through the borehole 35 are necessary to install the product pipe 16. In other examples, the drill rod 14 and the boring tool 40 are pulled to a predetermined location along the pilot bore 30 such that an operator can dig down into the ground G to access and remove the boring tool 40. The product pipe 16 can be a lengthy, continuous pipe or tube. In other examples, the product pipe 16 is segmented with multiple pipe sections connected to each other. In certain examples, the product pipe 16 comprises a plurality or bundle of conduits or pipes. In certain examples, the product pipe includes a plurality of pipe sections welded together or coupled together via threaded connections.

Figure 3:
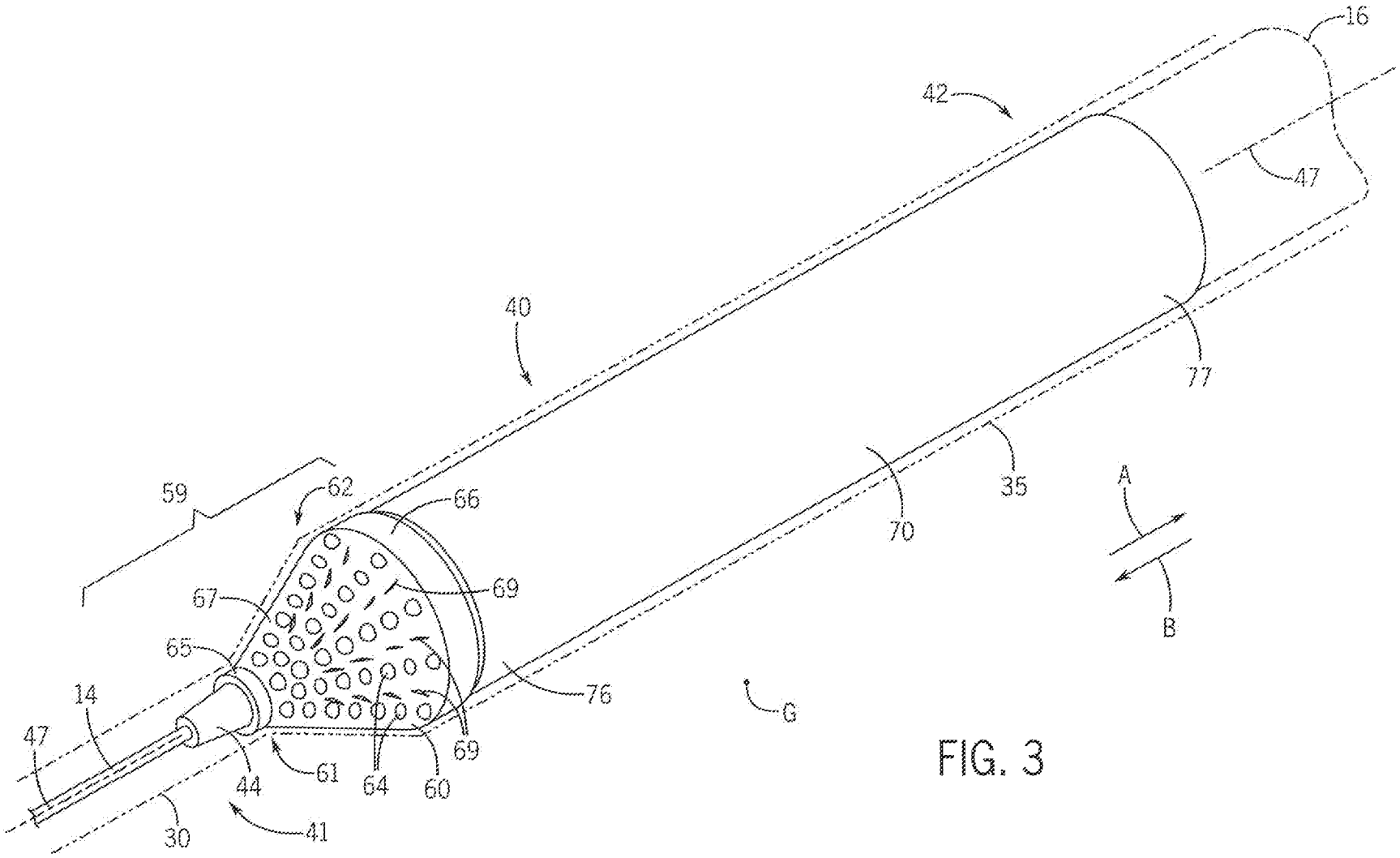
FIG. 3 is a perspective view of an example boring tool of the present disclosure within line 3-3 on FIG. 2.

Referring to FIG. 3, the boring tool 40 is depicted in greater detail. The boring tool 40 extends along an axis 47 and has a first end 41 orientated in the second direction (arrow B) toward the drilling rig 12 and an opposite, second end 42 orientated in the first direction (arrow A) away from the drilling rig 12 (see FIG. 2). Generally, the boring tool 40 has a threaded tool joint connector 44 at the first end 41 that releasably connects the boring tool 40 to the drill rod 14, a boring tool head 59 with a screen 60 that cuts or drills the ground G into spoils S as the boring tool 40 is pulled through the pilot bore 30, a housing 70 defining a chamber 71 (FIG. 4) in which certain components of the boring tool 40, such as a pump 100, are contained, and an arbor 90 at the second end 42 which is releasably connected to a product pipe 16 (as noted above). The housing 70 has a first end 76 and a second end 77. These components and other associated components are described in greater detail hereinbelow with respect to FIGS. 4-7.

Referring to FIG. 4-7, the connector 44 is configured to receive drilling fluid F from the drill rod 14 and dispense the drilling fluid F to an agitator 46 (described further herein). In particular, the connector 44 has a bore 45 in communication with the drill rod 14 such that the drilling fluid F is conveyed from the drill rod 14 through the bore 45 and into the agitator 46. In one example, the connector 44 is a threaded drill rod connection which is common in conventional HDD systems.

The agitator 46 extends along the axis 47 (FIG. 3) into a cavity 61 that is defined by the boring tool head 59 and/or the screen 60 (described further herein). The agitator 46 is connected to a support member 72 of the housing 70 that radially extends into the chamber 71 (note that the support member 72 is partially shown for clarity). The agitator 46 has a flow channel 48 through which the drilling fluid F is conveyed to openings 50 through which the drilling fluid F radially outwardly dispenses into the cavity 61 and toward the screen 60. In the example depicted, each opening 50 is part of a separate nozzle 51 and the nozzles 51 radially extend toward the screen 60 to thereby dispense (e.g., spray) the drilling fluid F radially towards the screen 60. The nozzles 51 can increase the velocity or the speed at which the drilling fluid F dispenses. In other examples, the openings 50 are holes in the exterior surface of the agitator 46. The agitator 46 includes auger flutes 52 configured to mix or agitate the drilling slurry SF in the cavity 61 and assist in conveyance of the drilling slurry SF in the first direction (arrow A). The agitator 46 is fixed relative to the connector 44 and/or the housing 70 and does not rotate relative to the connector 44 and/or the housing 70. In other examples, the agitator 46 may rotate about the axis 47.

As noted above, the screen 60 surrounds the agitator 46 and defines the cavity 61. The screen 60 generally extends along the axis 47 (FIG. 3) between a first end 62 located near the connector 44 and an opposite second end 62 located near housing 70. A rotating bearing 65 rotatably couples the first end 62 of the screen 60 to the agitator 46 and/or the connector 44, and a slewing bearing 66 rotatably couples the second end 63 of the screen 60 to the housing 70. As such, the screen 60 rotates about the axis 47 with the drill rod 14 and the connector 44. Note that the housing 70 and the agitator 46 do not rotate with the drill rod 14. The screen 60 has a plurality of holes 64 extending between an exterior surface 67 and an interior surface 68 of the screen 60 that permit drilling fluid F, spoils S, and/or drilling slurry SF to pass through the screen 60 and into the cavity 61. The screen 60 also has a plurality of blades 69 on and extending away from the exterior surface 67. The blades 69 are configured to cut the ground G and mix the spoils S with the drilling fluid F as the screen 60 rotates. The size and the shape of the screen 60 can vary, and in the example depicted, the screen 60 is a truncated cone with the narrow end at the first end 62 of the screen 60 and the enlarged end at the second end 63 of the screen 60. In other examples, the boring tool head 59 includes a tri-bit cone or any other suitable drilling bit for the soils encountered. In an example that includes a tri-bit cone, the boring tool 40 does not include a screen and instead has passageways or openings in fluid communication with the other components of the boring tool 40.

As the boring tool 40 is moved through the pilot bore 30 in the second direction (see arrow B on FIG. 2) to form the borehole 35 (as described above), the screen 60 rotates relative to the axis 47 (FIG. 3; note that rotation can be either in a clockwise direction or a counterclockwise direction relative to the axis 47) and ground G contacts the exterior surface 67 of the screen 60. The blades 69 cut the ground G into smaller pieces (e.g., spoils S) thereby drilling the borehole 35. The spoils S pass through the holes 64 in the screen 60 due to pressure forces between the ground G and the screen 60 acting on the spoils S, and the spoils S mix with the drilling fluid F to thereby form the drilling slurry SF. Furthermore, the fluid pressure of the drilling fluid F dispensed into the cavity 61 through the agitator 46 causes the drilling fluid F to flow or pass out of the cavity 61 through the holes 64 of the screen 60 such that the drilling fluid F mixes with the spoils S near the exterior surface 67 of the screen 60. The drilling fluid F that passes through the holes 64 also "lubricate" the spoils S exterior to the screen 60 and aids in the drilling of the ground G. The drilling fluid F dispensed toward the screen 60 cleans or clears the holes 64 in the screen 60 should the holes 64 become blocked. Any portion of the ground G not broken down or cut into smaller pieces during drilling (e.g., rocks) deflects off the tapered exterior surface 67 of the screen 60 and is displaced forced into the surrounding G by the screen 60. Accordingly, the screen 60 prevents materials from entering the boring tool 40 that may clog internal components of the boring tool 40 and/or pump 100.

Figure 4:
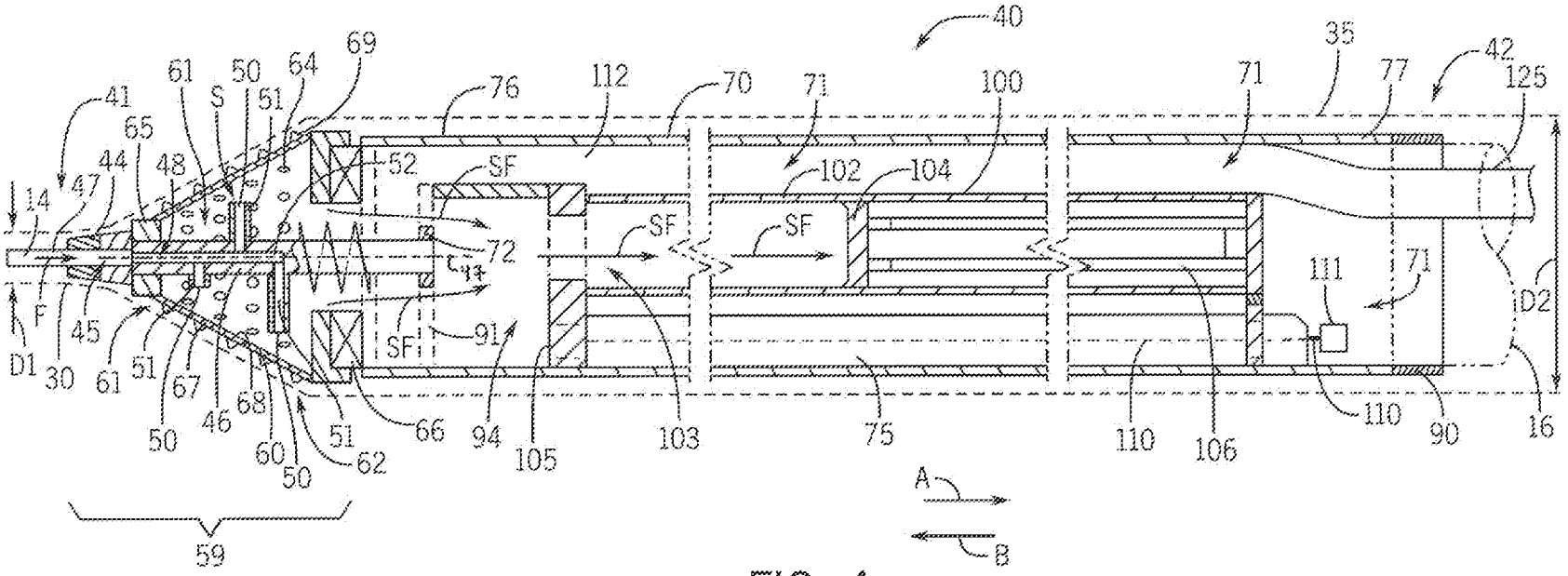
FIG. 4 is a cross-sectional view of an example boring tool of the present disclosure with a pump drawing drilling slurry into a material cylinder.
Figure 5:
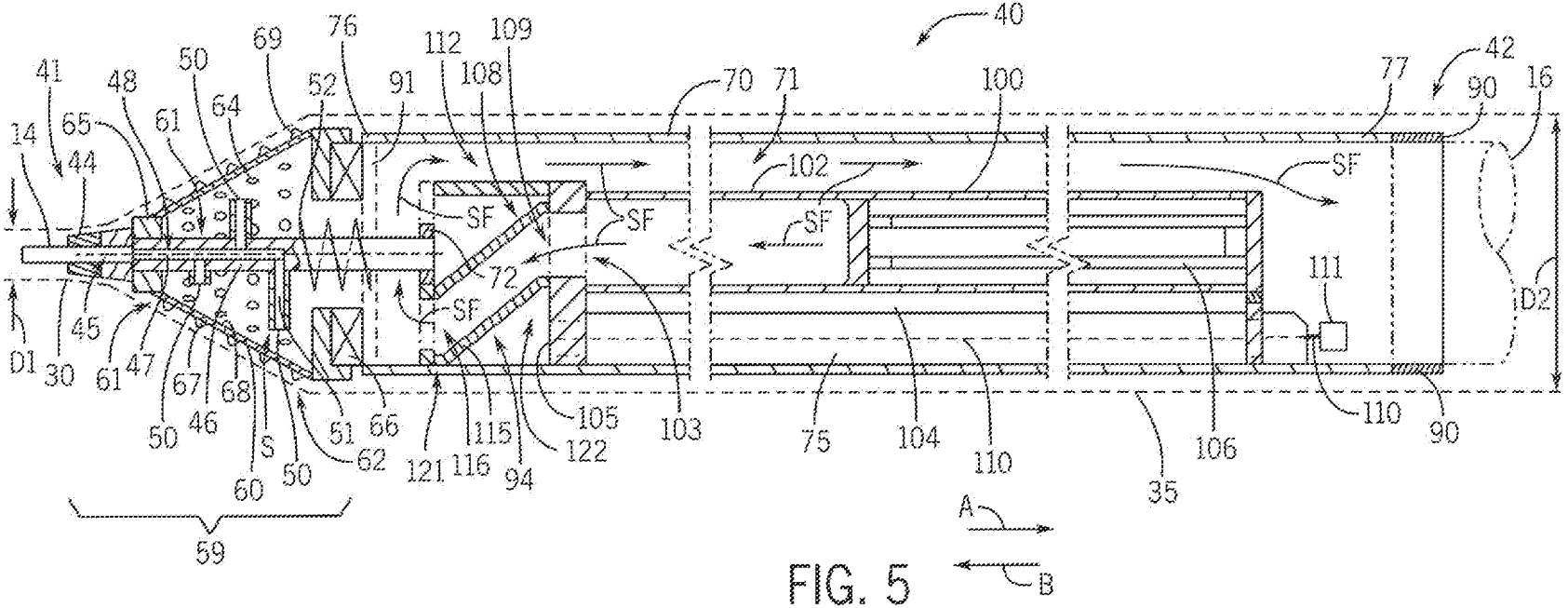
FIG. 5 is another cross-sectional view of an example boring tool of the present disclosure with the pump exhausting the drilling slurry from the material cylinder and through an exhaust pipe.
Figure 6:
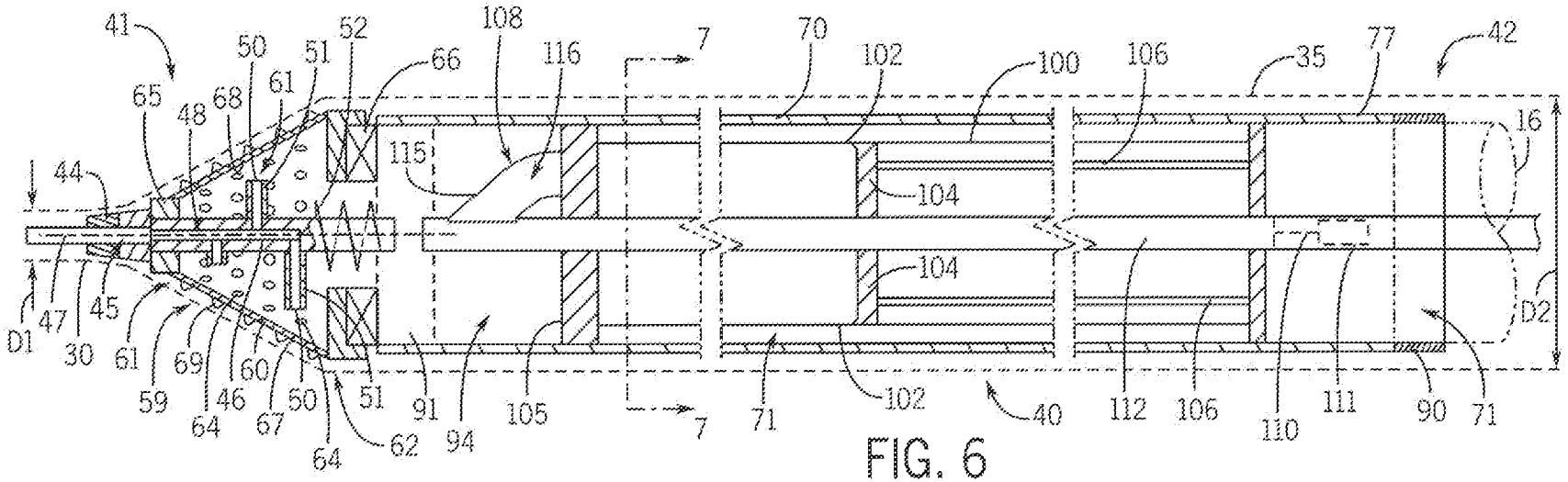
FIG. 6 is another cross-sectional view like FIG. 4 ninety-degrees rotationally offset from the cross-sectional view of FIG. 4.
Figure 7:
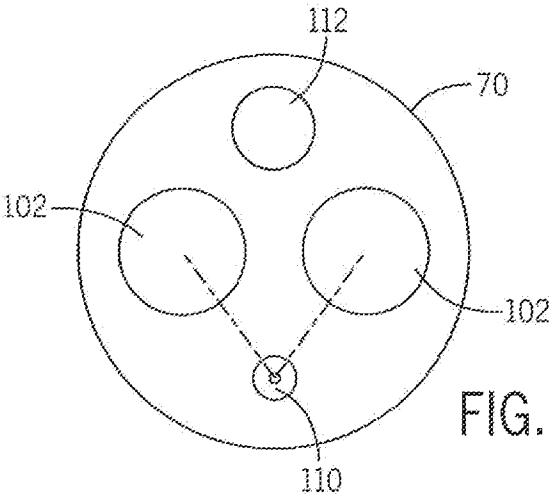
FIG. 7 is a cross-sectional view along line 7-7 on FIG. 6.

The drilling slurry SF in the cavity 61 is agitated by the drilling fluid F dispensing from the agitator 46 and the auger flutes 52. Pressures and/or suction forces created by the pump 100 create a pressure gradient between the first end 62 of the screen 60 and the pump 100 thereby causing the drilling slurry SF to move in the first direction (arrow A) toward the pump 100. In particular, the drilling slurry SF is conveyed in the first direction (arrow A) through one or more passages (not shown) past an exhaust manifold 91 (depicted in dashed lines; note the passages may be at least partially defined by the exhaust manifold 91) into a pump intake chamber 94 which is adjacent to the pump 100 (note the pump intake chamber 94 is within chamber 71). The pump 100 is a two cylinder positive displacement piston pump that has a pair of material cylinders 102 and a piston 104 in each cylinder 102 (note that FIG. 4 depicts one of the material cylinder 102 and one piston 104 and FIG. 6 depicts two material cylinders 102 and pistons 104). Each piston 104 is moved (e.g., reciprocated) in the material cylinder 102 by an actuator 106 (described furtherherein). The actuator 106 can be any suitable device capable of moving the piston 104 in the material cylinder 102, and in the example depicted in FIG. 4, the actuator 106 is a hydraulic cylinder connected to a hydraulic system (not shown). Note that the hydraulic system can be in the housing 70 or connected to the housing 70 and the actuator 106 via hydraulic fluid lines. In other examples, the actuator 106 can be electrically, mechanically, or pneumatically driven by corresponding systems. In one example, the actuator 106 is a hydraulic cylinder driven by a hydraulic system having a hydraulic pressure circuit with a pneumatic accumulator to thereby increase cycling of the pump in order to reduce material leakage and improve pumping efficiency. In other examples, the pump 100 includes a single material cylinder, piston, and actuator. In certain examples, the material cylinders 102 are chrome plated for wear resistance. In certain examples, the pump 100 could include single material cylinder 102, piston 104, and actuator 106.

In operation, the actuator 106 moves the piston 104 in the first direction (arrow A) away from the pump intake chamber 94 such that the drilling slurry SF is pulled into the material cylinder 102 via an opening 103 (note FIG. 4 depicts the piston 104 moved partially in the first direction A). The movement of the piston 104 in the first direction (arrow A) is an intake stroke. After the intake stroke of the piston 104 is complete (e.g., the actuator 106 moves the piston 104 to the end of the material cylinder 102), the material cylinder 102 is filled with drilling slurry SF. A valve 108 is positioned in the pump intake chamber 94 and extends between the pump 100 and the exhaust manifold 91. The valve 108 has a tube 115 defining a channel 116 that is moved into alignment with the opening 103 of the material cylinder 102 (e.g., the opening of the channel 116 aligns with the opening of the 103 of the material cylinder). When the channel 116 is aligned with the opening 103, the actuator 106 moves the piston 104 in a second direction (arrow B) toward the pump intake chamber 94 such that the drilling slurry SF is forced out of the material cylinder 102 and into the channel 116 (see FIG. 5; note that the valve 108 is excluded from FIG. 4 for clarity). The movement of the piston 104 in the second direction (arrow B) is an exhaust stroke. The tube 115 directs the drilling slurry SF into the exhaust manifold 91 which directs the drilling slurry SF to an exhaust pipe 112. The exhaust pipe 112 dispenses the drilling slurry SF into the product pipe 16 or an exhaust tube 125 inside of the product pipe 16. The valve 108 is then moved away from the opening 103 and the intake stroke is repeated to draw additional drilling slurry SF into the material cylinder 102 from the pump intake chamber 94. As such, repeated intake strokes and exhaust strokes of the piston 104 pumps the drilling slurry SF out of the boring tool 40 and ultimately out of the borehole 35 via the product pipe 16. The weight of the drilling slurry SF in the product pipe 16 prevents the product pipe 16 from "floating" up in the borehole 35. In other examples, the exhaust pipe 112 is connected to an exhaust tube 125 that extends in the product pipe 16 to a connection tank or vehicle (not shown). In size and shape of the valve 108 and/or the tube 115 can vary. For example, the tube is an "S"-shaped tube or pipe. The tube 115 has a first end 121 coupled to the exhaust manifold 91 and a second end 122 that is moved into alignment with the openings 103 of the material cylinders 102. In certain examples, the valve 108 is a hydraulically actuated poppet valve or a ball and seal valve.

As noted above, the pump 100 includes a pair of cylinders 102 with pistons 104 and an actuator 106 for moving each piston 104. Accordingly, as the first piston 104 in the first material cylinder 102 is moved to draw drilling slurry SF into the material cylinder 102 from the pump intake chamber 94 (e.g., the intake stroke) the second piston 104 in the second material cylinder 102 is simultaneously moved to push drilling slurry SF out of the second material cylinder 102 (e.g., the exhaust stroke) into the valve 108 and the exhaust manifold 91. The intake and exhaust strokes are continuously repeated and the valve 108 repeatedly moves to receive the exhausting drilling fluid SF from both material cylinders 102, and therefore, the pump 100 continuously pumps the drilling slurry SF. The operation of the pump 100 is described in greater detail hereinbelow with reference to FIGS. 8A-8C.

Figures 8A, 8B, 8C:
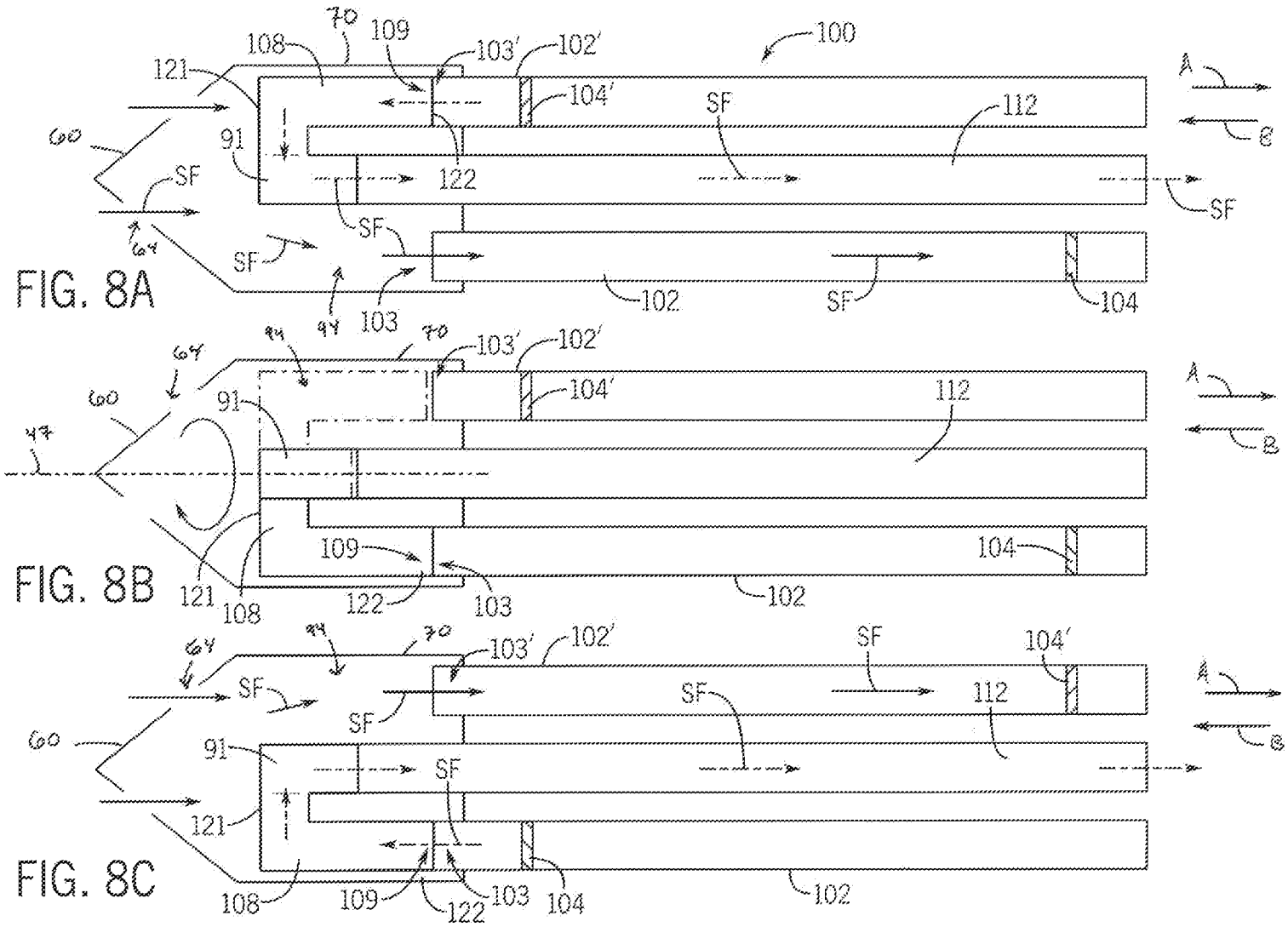
FIGS. 8A-8C depict an example operational sequence of the pump and a valve.

FIG. 8A depicts a first material cylinder 102 with a first piston 104 and a second material cylinder 102' with a second piston 104'. The first piston 104 is depicted moved in the first direction (arrow A) such that the slurry fluid SF is moved in the first direction (arrow A) through the cavity 61, the pump intake chamber 94, and the opening 103 into the first material cylinder 102. The valve 108 is in a second position such that an opening 109 of the valve 108 is in fluid communication with the opening 103' of the second material cylinder 102' (e.g., the opening 109 of the valve 108 aligns with the opening 103' of the second material cylinder 102'). As such, the drilling slurry SF is forced (e.g., pumped) out of the second material cylinder 102' through the valve 108, the exhaust manifold 91, and the exhaust pipe 112. Note that for clarity the housing 70 is only partially depicted.

FIG. 8B depicts the valve 108 rotated from the second position (see FIG. 8A) into a first position (see also FIG. 8C). The valve 108 is rotated by a valve actuator 111 (see FIG. 4). The rotation of the valve 108 into and between the first position and the second position (FIG. 8A) is instantaneous with the completion of each stroke of the pistons 104. The valve actuator 111 can be any suitable device configured to move the valve 108 between the first and the second position. The valve actuator 111 provides the necessary torque to move the tube 115 through the drilling slurry SF in the pump intake chamber 94. In the example depicted in FIG. 4, the valve actuator 111 is coupled to a driveshaft 110 (FIG. 4) that is coupled to the valve 108 such that as the driveshaft 110 is rotated by the valve actuator 111 the valve 108 is also rotated. The driveshaft 110 extends along an axis that corresponds to a center axis of an exhaust opening of the valve 108. In this example, the valve actuator 111 is a hydraulic rotary actuator. In another example, the valve actuator 111 is a helical hydraulic rotary actuator. As the tube 115 is moved between the first position and the second position, the second end 122 slides on a sealing surface 105 of the pump 100. In certain examples, the valve 108 is actuated by hydraulic cylinders with mechanical linkages.

FIG. 8C depicts the second piston 104' is moved in the first direction (arrow A) such that the slurry fluid SF is moved in the first direction (arrow A) through the cavity 61, the pump intake chamber 94, and the opening 103 into the second material cylinder 102'. The valve 108 is in the first position such that the opening 109 of the valve 108 is in fluid communication with the opening 103 of the first material cylinder 102 (e.g., the opening 109 of the valve 108 aligns with the opening 103 of the first material cylinder 102). As such, the drilling slurry SF is pumped out of the first material cylinder 102 through the valve 108, the exhaust manifold 91, and the exhaust pipe 112. Rotation of the valve 108 and reciprocation of the pistons 104, 104' in the material cylinders 102, 102', respectively, is repeated (as described above) such that the pump 100 continuously pumps the drilling slurry SF out of the boring tool 40 and the borehole 35. In certain examples, the pump 100 includes bypass circuits with check valves on each material cylinder 102 such that after each stroke or cycle the bypass circuits automatically re-phase.

Referring back to FIG. 3, the housing 70 also contains a water tank 75 in the chamber 71 that is filled with water (or another cooling fluid) that is configured to lubricate the material cylinders 102 and the cool the actuators 106 (e.g., hydraulic cylinders). In one example, the pump 100 is surrounded by the water tank 75. The water tank 75 has a pressure relief device to release pressure as the temperature of the water in the water tank 75 increases. In the example depicted in FIGS. 4-5, the water tank 75, the exhaust manifold 91, the pump intake chamber 94, the pump 100, the valve 108, the driveshaft 110, the valve actuator 111, and the exhaust pipe 112 are in the chamber 71 defined by the housing 70. In other examples, the certain components may be located outside the chamber 71.

In certain examples, the boring tool 40 includes a tracker (not shown) that permits the operator of the system 10 to monitor and/or locate the boring tool 40 underground. For example, the tracker may be a transmitter capable of sending electronic signals to a receiver above ground. In other examples, the tracker is a GPS transmitter capable of transmitting GPS location signals or data to a receiver above ground.

Figure 9:
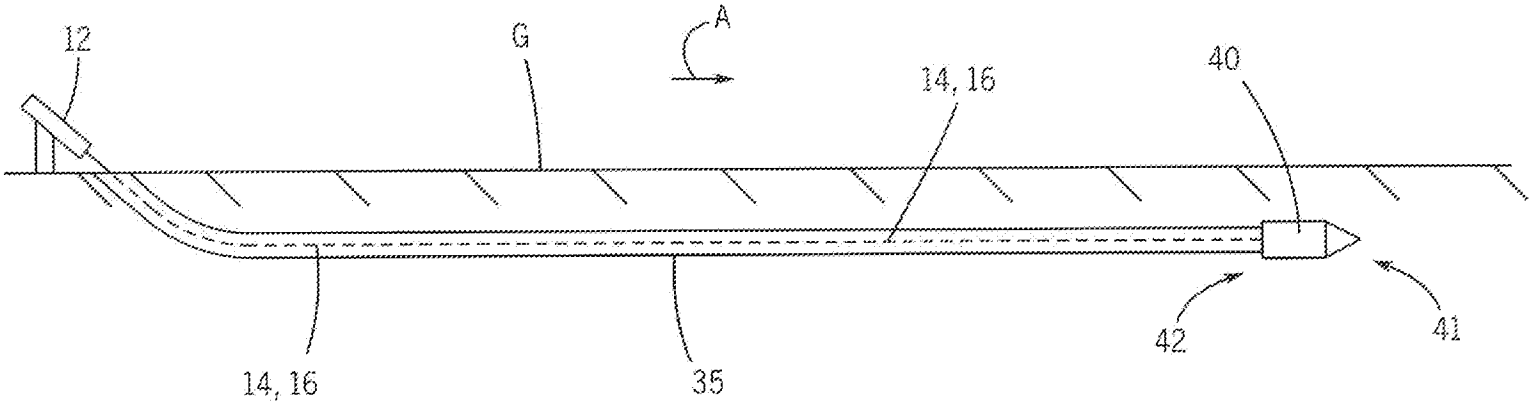
FIG. 9 is a schematic view of the example boring tool of the present disclosure depicted drilling the pilot hole and installing product pipe into the pilot hole.

The boring tool 40 can be utilized in alternative ways to bore holes. In one alternative example, referring to FIG. 9, the boring tool 40 can replace the pilot bore drill head 20 (FIG. 1) such that the boring tool 40 drills the pilot bore 30. That is, the boring tool 40 drills the pilot hole 20 and/or installs product pipe 16 directly into the pilot bore 30. The boring tool 40 drills the pilot hole 20 in a similar fashion as discussed above with respect to the boring tool 40 drilling the borehole 30. This alternative example can be utilized when the drill rod 14 is left in place as the product pipe.

In certain examples, a method of drilling a borehole with a diameter greater than a diameter of an existing pilot hole with a drill rod therein includes the steps of: coupling a boring apparatus having a pump to the drill rod; pulling the drill rod and the boring apparatus through the pilot hole to thereby drill the borehole; receiving drilling fluid into the boring apparatus via the drill rod; receiving ground spoils generated by the boring apparatus as the boring apparatus is pulled through the pilot hole into the boring apparatus such that the drilling fluid and the ground spoils form a drilling slurry; and pumping, with the pump, the drilling slurry out of the boring apparatus and the borehole. In certain examples, the method also includes connecting a product pipe to the boring apparatus such that the product pipe is pulled into the borehole as the boring apparatus drills the borehole. In other examples, a method of drilling a borehole includes the steps of: coupling a boring apparatus having a pump to a drill rod; driving the drill rod and the boring apparatus through ground to thereby drill the borehole; receiving drilling fluid into the boring apparatus via the drill rod; receiving ground spoils generated by the boring apparatus into the boring apparatus such that the drilling fluid and the ground spoils form a drilling slurry; and pumping, with the pump, the drilling slurry out of the boring apparatus and the borehole.

In certain examples, a method of drilling a borehole with a diameter greater than a diameter of an existing pilot hole includes pulling a boring apparatus having a pump through the pilot hole to thereby drill the borehole, receiving drilling fluid into the boring apparatus, receiving ground spoils into the boring apparatus that are generated as the boring apparatus is pulled through the pilot hole such that the drilling fluid and the ground spoils mix to form a drilling slurry, and pumping the drilling slurry out of the boring apparatus and the borehole.

In certain examples, a method of drilling a borehole includes pushing a boring apparatus having a pump through ground to thereby drill the borehole, receiving drilling fluid into the boring apparatus, receiving ground spoils into the boring apparatus that are generated as the boring apparatus is pushed through ground such that the drilling fluid and the ground spoils mix to form a drilling slurry, and pumping the drilling slurry out of the boring apparatus and the borehole.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A boring apparatus for coupling to a drill rod and drilling a borehole, the boring apparatus comprising:

a boring tool head configured to couple to the drill rod and receive drilling fluid, the boring tool head having an exterior surface with a hole and defining a cavity, wherein the hole is configured to permit ground spoils to pass into the cavity, and wherein the drilling fluid dispenses into the cavity and mixes with the ground spoils to form a drilling slurry;

a housing coupled to the boring tool head and having a chamber in fluid communication with the cavity, wherein the housing has a first end coupled to the boring tool head and a second end configured to couple to a product pipe;

a pump in the chamber that is configured to pump the drilling slurry out of the cavity and the chamber, the pump has:

a first material cylinder;

a second material cylinder;

a first piston that is reciprocated in the first material cylinder to thereby draw the drilling slurry into the first material cylinder and subsequently push the drilling slurry out of the first material cylinder; and a second piston that is reciprocated in the second material cylinder to thereby draw the drilling slurry into the second material cylinder and subsequently push the drilling slurry out of the second material cylinder;

a valve in the chamber that is configured to receive the drilling slurry when the drilling slurry is pushed out of the first material cylinder and the second material cylinder;

a valve actuator that moves the valve into and between a first position in which the valve receives the drilling slurry from the first material cylinder and a second position in which the valve receives the drilling slurry from the second material cylinder;

an exhaust manifold configured to receive the drilling slurry from the valve; and an exhaust pipe configured to receive the drilling slurry from the exhaust manifold and dispense the drilling slurry out of the chamber; and wherein the pump is configured to pump the drilling slurry through the product pipe; and wherein when the first piston is moved in a first direction, the second piston is moved in a second direction opposite the first direction and when the second piston is moved in the first direction, the second piston is moved in the second direction such that the pump continuously pumps the drilling slurry; and wherein the valve has a tube with a first end coupled to the exhaust manifold and an opposite second end, and wherein the pump has a sealing surface along which the second end of the tube slides as the valve is moved between the first position and the second position.

2. The boring apparatus according to claim 1, further comprising an exhaust tube coupled to the second end of the housing such that the pump is configured to pump the drilling slurry through the exhaust tube.

3. The boring apparatus according to claim 1, wherein the drilling slurry is dispensed from the exhaust pipe in the first direction.

4. The boring apparatus according to claim 1, wherein the pump has a first actuator configured to reciprocate the first piston in the first material cylinder and a second actuator configured to reciprocate the second piston in the second material cylinder.

5. The boring apparatus according to claim 4, wherein the first actuator and the second actuator are hydraulic cylinders.

6. The boring apparatus according to claim 1, further comprising a driveshaft coupled to the valve actuator such that as the value actuator rotates the driveshaft, the valve is rotated.

7. The boring apparatus according to claim 1, wherein the valve actuator is a helical hydraulic rotary actuator.

8. A boring apparatus for coupling to a drill rod and drilling a borehole, the boring apparatus comprising:

a boring tool head configured to couple to the drill rod and receive drilling fluid, the boring tool head having an exterior surface with a hole and defining a cavity, wherein the hole is configured to permit ground spoils to pass into the cavity, and wherein the drilling fluid dispenses into the cavity and mixes with the ground spoils to form a drilling slurry;

a housing coupled to the boring tool head and having a chamber in fluid communication with the cavity; and a pump in the chamber that is configured to pump the drilling slurry out of the cavity and the chamber;

wherein the boring tool head has a screen that includes the exterior surface and the hole, wherein the hole is one a plurality of holes, and wherein the screen is configured to deflect ground spoils larger than one hole of the plurality of holes away from the boring tool head;

wherein the boring tool head has a connector configured to couple to the drill rod and receive the drilling fluid and an agitator extending along an axis in the cavity, wherein the agitator is configured to receive the drilling fluid from the connector and radially outwardly dispense the drilling fluid toward the screen;

wherein the agitator has a plurality of nozzles configured to spray the drilling fluid radially outwardly toward the screen.

9. The boring apparatus according to claim 8 wherein the screen has a truncated conical shape centered about an axis.

10. The boring apparatus according to claim 9, wherein the screen is configured to rotate independent of the housing.

11. The boring apparatus according to claim 10, wherein the boring tool head has a connector configured to couple to the drill rod and receive the drilling fluid, a swivel bearing that couples the screen to the connector, and a slewing bearing that rotatably couples the screen to the housing, and wherein the connector and the screen are configured to rotate with the drill rod.

12. The boring apparatus according to claim 8, wherein the screen and the connector are configured to rotate independent of the housing, and wherein the agitator is fixed relative to the housing.

13. A boring apparatus for coupling to a drill rod and drilling a borehole, the boring apparatus comprising:

a boring tool head configured to couple to the drill rod and receive drilling fluid, the boring tool head having an exterior surface with a hole and defining a cavity, wherein the hole is configured to permit ground spoils to pass into the cavity, and wherein the drilling fluid flows into the cavity and mixes with the ground spoils to form a drilling slurry;

a housing coupled to the boring tool head and having a chamber in fluid communication with the cavity;

a pump in the chamber that is configured to pump the drilling slurry out of the cavity and the chamber, wherein the pump has a sealing surface;

a valve in the chamber that is configured to receive the drilling slurry from the pump, wherein the valve has a tube with a first end and an opposite second end;

a valve actuator that moves the valve into and between a first position and a second position such that the valve receives the drilling slurry from the pump when the valve is in the first position and the second position;

an exhaust manifold configured to receive the drilling slurry from the valve; and an exhaust pipe configured to receive the drilling slurry from the exhaust manifold and dispense the drilling slurry out of the chamber;

wherein the first end of the tube is coupled to the exhaust manifold, and wherein as the valve is moved between the first position and the second position, the second end of the tube is moved along the sealing surface.

* * * * *